US008057757B2

(12) United States Patent
Bedingham et al.

(10) Patent No.: US 8,057,757 B2
(45) Date of Patent: Nov. 15, 2011

(54) SAMPLE MIXING ON A MICROFLUIDIC DEVICE

(75) Inventors: William Bedingham, Woodbury, MN (US); Barry W. Robole, Woodville, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/902,489

(22) Filed: Oct. 12, 2010

(65) Prior Publication Data

US 2011/0027904 A1 Feb. 3, 2011

Related U.S. Application Data

(62) Division of application No. 10/734,682, filed on Dec. 12, 2003, now Pat. No. 7,837,947.

(51) Int. Cl.
*B01L 3/00* (2006.01)

(52) U.S. Cl. ..... 422/503; 422/500; 422/501; 436/180

(58) Field of Classification Search ..... 436/180; 422/502, 506, 500–501, 503
See application file for complete search history.

(56) References Cited

U.S. PATENT DOCUMENTS

| | | | | |
|---|---|---|---|---|
| 3,873,217 | A | | 3/1975 | Anderson et al. |
| 5,693,233 | A | * | 12/1997 | Schembri ..... 210/787 |
| 5,912,134 | A | | 6/1999 | Shartle |
| 6,063,589 | A | | 5/2000 | Kellogg et al. |
| 6,143,247 | A | | 11/2000 | Sheppard, Jr. et al. |
| 6,143,248 | A | | 11/2000 | Kellogg et al. |
| 6,302,134 | B1 | | 10/2001 | Kellogg et al. |
| 6,527,432 | B2 | | 3/2003 | Kellogg et al. |
| 6,548,788 | B2 | | 4/2003 | Kellogg et al. |
| 6,582,662 | B1 | | 6/2003 | Kellogg et al. |
| 6,627,159 | B1 | | 9/2003 | Bedingham et al. |
| 6,632,399 | B1 | | 10/2003 | Kellogg et al. |
| 7,322,254 | B2 | | 1/2008 | Bedingham et al. |
| 7,332,126 | B2 | | 2/2008 | Tooke |
| 2002/0047003 | A1 | | 4/2002 | Bedingham et al. |
| 2002/0048533 | A1 | | 4/2002 | Harms et al. |
| 2002/0064885 | A1 | | 5/2002 | Bedingham et al. |
| 2003/0044322 | A1 | | 3/2003 | Andersson et al. |
| 2003/0053934 | A1 | | 3/2003 | Andersson et al. |
| 2003/0138779 | A1 | | 7/2003 | Parthasarathy et al. |
| 2003/0152491 | A1 | | 8/2003 | Kellogg et al. |
| 2005/0129583 | A1 | | 6/2005 | Bedingham et al. |

FOREIGN PATENT DOCUMENTS

JP 2003-520582 7/2003

OTHER PUBLICATIONS

International Search Report PCT/US2004/034749, Mar. 3, 2005, 5 Pgs.

* cited by examiner

*Primary Examiner* — Jyoti Nagpaul
(74) *Attorney, Agent, or Firm* — Nicole J. Einerson

(57) ABSTRACT

Mixing structures for use on sample processing devices are disclosed. The mixing structures include one or more mixing chambers in fluid communication with a process chamber, such that changing the rotational speed of the sample processing device forces sample material into and out of the mixing chamber to achieve mixing of the sample material. The mixing chambers are in fluid communication with the process chambers through mixing ports that are located on the distal sides of the process chambers with respect to the axis about which the sample processing device is rotated.

10 Claims, 4 Drawing Sheets

SAMPLE MIXING ON A MICROFLUIDIC DEVICE

CROSS-REFERENCE TO RELATED APPLICATIONS

This is a divisional of U.S. patent application Ser. No. 10/734,682, filed Dec. 12, 2003, now U.S. Pat. No. 7,837,947.

FIELD

The present invention relates to the mixing of fluid samples in a microfluidic sample processing device.

BACKGROUND

Sample processing devices including process chambers in which various chemical or biological processes are performed play an increasing role in scientific and/or diagnostic investigations. The process chambers provided in such devices are preferably small in volume to reduce the amount of sample material required to perform the processes.

One persistent issue associated with sample processing devices including process chambers is in the mixing of materials in the process chambers. For example, mixing may be useful to improve utilization of reagents and/or sample utilization. Many sample processing devices are, however, designed to use small volumes of sample material (e.g., 5 microliters) that are not easily accessed after loaded into the sample processing devices designed to process such small sample volumes.

SUMMARY OF THE INVENTION

The present invention provides mixing structures for use on sample processing devices. The mixing structures include one or more mixing chambers in fluid communication with a process chamber, such that changing the rotational speed of the sample processing device forces sample material into and out of the mixing chamber to achieve mixing of the sample material. The mixing chambers are in fluid communication with the process chambers through mixing ports that are located on the distal sides of the process chambers with respect to the axis about which the sample processing device is rotated.

One potential advantage of the mixing structures of the present invention is that mixing can still be performed even if the process chamber volume is larger than the sample volume. Mixing can still occur because rotation of a partially filled process chamber can still move sample material into the mixing chamber because the mixing port is located on the distal side of the process which is where the sample material will be driven during rotation of the sample processing device.

In some embodiments, the process chambers may include exit ports that are also located on the distal side of the process chambers. One potential advantage of such a construction may be, e.g., enhanced emptying of the mixing chambers and the process chambers.

In other embodiments, the mixing chamber may be located within the footprint of the process chamber. One potential advantage of such a construction is that the area on the sample processing device occupied by the process chamber and associated mixing structure can be reduced.

In one aspect, the present invention provides a sample mixing structure on a sample processing device, the sample mixing structure including a process chamber with a delivery port on a proximal side of the process chamber and an exit port on a distal side of the process chamber; a mixing chamber with a mixing port, wherein the mixing port is located on the distal side of the process chamber. Rotation of the sample processing device about an axis of rotation moves at least a portion of sample material in the processing chamber into the mixing chamber through the mixing port when the mixing port is open, wherein the proximal side of the process chamber is located closer to the axis of rotation than the distal side of the process chamber. When the exit port of the process chamber is open, rotation of the sample processing device about the axis of rotation moves the sample material out of the process chamber and the mixing chamber.

In another aspect, the present invention provides sample mixing structure on a sample processing device, the sample mixing structure including a process chamber with a delivery port on a proximal side of the process chamber and an exit port on a distal side of the process chamber, wherein the exit port is closed; and a mixing chamber with a mixing port, wherein the mixing port is located on the distal side of the process chamber. The process chamber is located between a first major side and a second major side of the sample processing device, wherein at least a portion of the mixing chamber is located between the process chamber and the second major side of the sample processing device. Rotation of the sample processing device about an axis of rotation moves at least a portion of sample material in the processing chamber into the mixing chamber through the mixing port when the mixing port is open, wherein the proximal side of the process chamber is located closer to the axis of rotation than the distal side of the process chamber. When the exit port of the process chamber is open, rotation of the sample processing device about the axis of rotation moves the sample material out of the process chamber and the mixing chamber.

In another aspect, the present invention provides sample mixing structure on a sample processing device, the sample mixing structure including a process chamber with a delivery port on a proximal side of the process chamber and an exit port on a distal side of the process chamber; a first mixing chamber in fluid communication with the process chamber through a first mixing port, wherein the first mixing port is located on the distal side of the process chamber; and a second mixing chamber in fluid communication with the process chamber through a second mixing port, wherein the second mixing port is located on the distal side of the process chamber. Rotation of the sample processing device about an axis of rotation moves at least a portion of sample material in the processing chamber into at least one of the first mixing chamber and the second mixing chamber, wherein the proximal side of the process chamber is located closer to the axis of rotation than the distal side of the process chamber. When the exit port of the process chamber is open, rotation of the sample processing device about the axis of rotation moves the sample material out of the first mixing chamber, the second mixing chamber, and the process chamber.

In another aspect, the present invention provides a method of mixing fluids in a sample processing device. The method includes providing a sample processing device that includes a process chamber, at least one mixing chamber, and at least one mixing port located on a distal side of the process chamber; providing sample material in the process chamber; rotating the sample processing device about an axis of rotation, wherein at least a portion of sample material in the processing chamber moves into the at least one mixing chamber through the at least one mixing port when rotating the sample processing device, wherein the rotating comprises at least one acceleration and deceleration cycle.

In another aspect, the present invention provides a method of mixing fluids in a sample processing device. The method includes providing a sample processing device having a process chamber, at least one mixing chamber, and at least one mixing port located on a distal side of the process chamber; providing sample material in the process chamber; rotating the sample processing device about an axis of rotation, wherein at least a portion of sample material in the processing chamber moves into the at least one mixing chamber through the at least one mixing port when rotating the sample processing device, wherein the rotating comprises two or more acceleration and deceleration cycles. The method also includes opening an exit port in the process chamber after rotating the sample processing device to move at least a portion of sample material in the processing chamber into the at least one mixing chamber; and removing at least a portion of the sample material from the process chamber through the exit port by rotating the sample processing device about the axis of rotation.

These and other features and advantages of the present invention may be described in connection with various illustrative embodiments of the invention below.

DETAILED DESCRIPTION OF ILLUSTRATIVE EMBODIMENTS OF THE INVENTION

Figure 1:
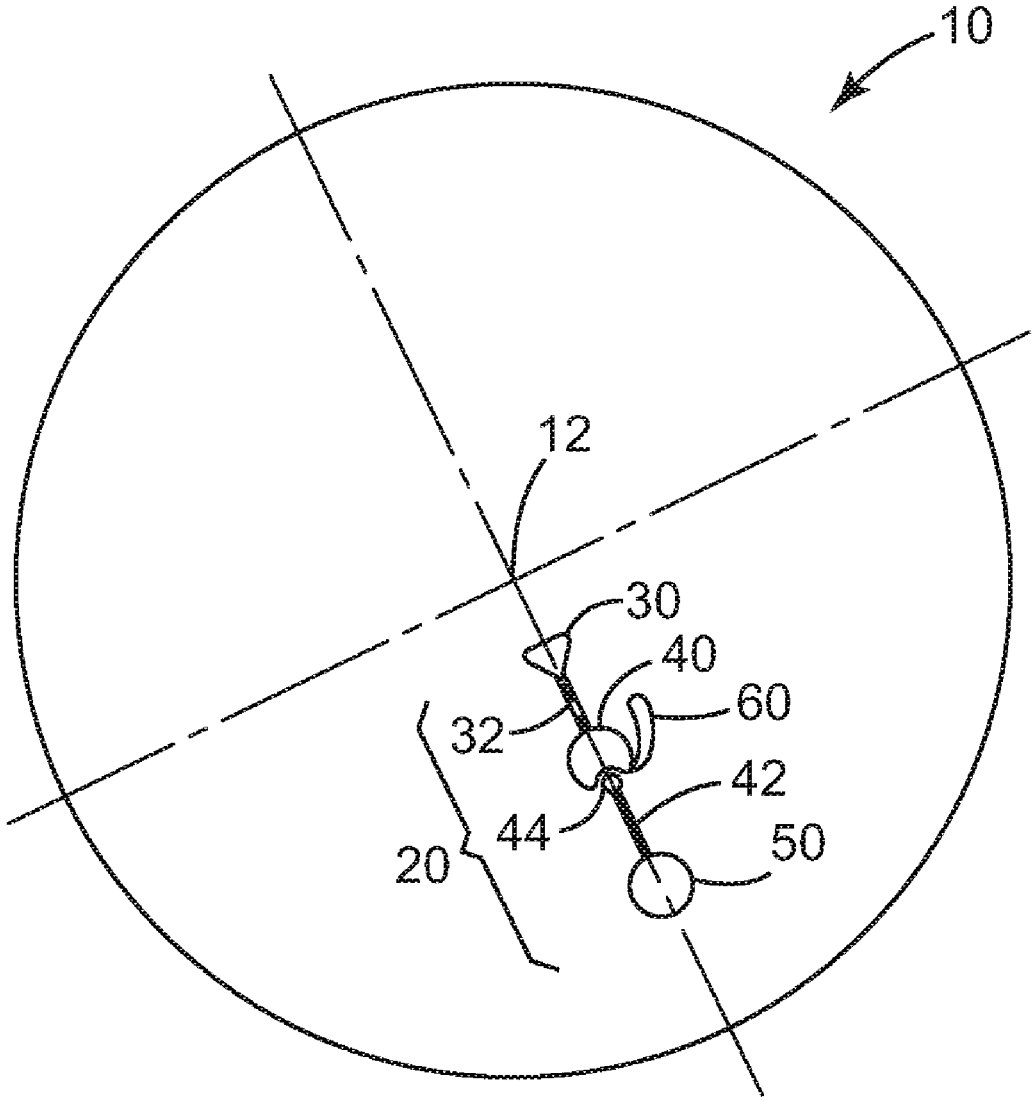
FIG. 1 is a plan view of one exemplary sample processing device according to the present invention.

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

The present invention provides a sample processing device that can be used in the processing of liquid sample materials (or sample materials entrained in a liquid) in multiple process chambers to obtain desired reactions, e.g., PCR amplification, ligase chain reaction (LCR), self-sustaining sequence replication, enzyme kinetic studies, homogeneous ligand binding assays, and other chemical, biochemical, or other reactions that may, e.g., require precise and/or rapid thermal variations. More particularly, the present invention provides sample processing devices that include one or more process arrays, each of which may preferably include a loading chamber, at least one process chamber, a valve chamber, and conduits for moving fluids between various components of the process arrays.

Although various constructions of illustrative embodiments are described below, sample processing devices of the present invention may be similar to those described in, e.g., U.S. Patent Application Publication Nos. US2002/0064885 (Bedingham et al.); US2002/0048533 (Bedingham et al.); US2002/0047003 (Bedingham et al.), and US2003/138779 (Parthasarathy et al.); as well as U.S. Pat. No. 6,627,159 B1 (Bedingham et al.) and U.S. Pat. No. 7,322,254 (Bedingham et al.). The documents identified above all disclose a variety of different constructions of sample processing devices that could be used to manufacture sample processing devices according to the principles of the present invention.

One illustrative sample processing device manufactured according to the principles of the present invention is illustrated in FIG. 1 which is a plan view of one sample processing device 10 that may include process chambers and associated mixing structures of the present invention. The sample processing device 10 may preferably be in the shape of a circular disc as illustrated in FIG. 1, although any other shape that can be rotated could be used in place of a circular disc, e.g., rectangular, etc.

The sample processing device 10 includes at least one process array 20 as seen in FIG. 1. In other embodiments, it may be preferred that the sample processing device 10 include two or more process arrays 20. If the sample processing device 10 is circular as depicted, it may be preferred that each of the depicted process array 20 includes components that are aligned with a radial axis 21 extending from proximate a center 12 of the sample processing device 10 towards the periphery of the sample processing device 10. Although this arrangement may be preferred, it will be understood that any arrangement of process arrays 20 on sample processing device 10 may alternatively be used.

The sample processing device 10 is designed to be rotated to effect fluid movement through the process array 20. It may be preferred that the axis of rotation extend through the center 12 of the sample processing device 10, although variations therefrom may be possible.

The process array 20 preferably includes at least one process chamber 40. In the depicted embodiment, the process array 20 also includes an optional loading chamber 30 connected to the process chamber 40 along a conduit 32. The process chamber 40 may preferably be connected to a second process chamber 50 connected to the first process chamber 40 along conduit 42. The process chamber 40 may preferably include a valve 44 to control movement from the process chamber 40 to the secondary process chamber 50. The valve 44 may preferably be normally closed until opened. The process array 20 also includes a mixing chamber 60 in fluid communication with the process chamber 40.

It should be understood that a number of the features associated with the process array 20 may be optional. For example, the loading chamber 30 and associated conduit 32 may be optional where sample material can be introduced directly into the process chamber 40 through a different loading structure. Other optional features may include, e.g., the valve 40 and/or the secondary process chamber 50 and the conduit 42 leading to it.

Any loading structure provided in connection with the process arrays 20 (e.g., loading chamber 30) may be designed to mate with an external apparatus (e.g., a pipette, hollow syringe, or other fluid delivery apparatus) to receive the sample material. The loading structure itself may define a volume (as, e.g., does loading chamber 30 of FIG. 1) or the loading structure may define no specific volume, but, instead, be a location at which sample material is to be introduced. For example, the loading structure may be provided in the form of a port through which a pipette or needle is to be inserted. In one embodiment, the loading structure may be, e.g., a designated location along a conduit that is adapted to receive a pipette, syringe needle, etc. The loading may be performed manually or by an automated system (e.g., robotic, etc.). Further, the sample processing device 10 may be loaded directly from another device (using an automated system or manually).

Figure 2:
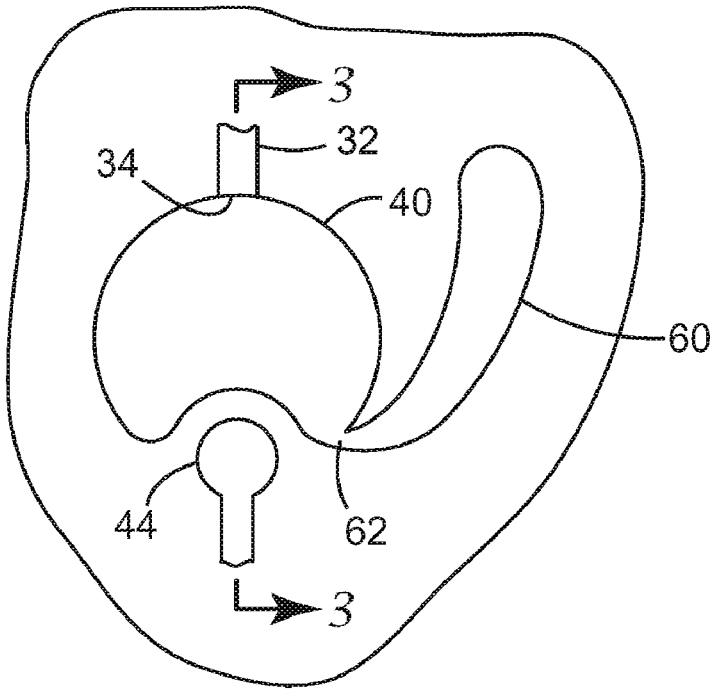
FIG. 2 is an enlarged view of one exemplary mixing structure and associated process chamber according to the present invention.

FIG. 2 is an enlarged plan view of the process chamber 40 and its associated mixing structure in the form of a mixing chamber 60 and mixing port 62 through which the mixing chamber 60 is in fluid communication with the volume of the process chamber 40.

It may be preferred that the mixing port 62 be located on the distal side of the process chamber 40 where the distal side of the process chamber 40 is defined as that side of the process chamber 20 that is located distal from the axis of rotation about which the sample processing device 10 is rotated to effect fluid movement through the process array 20 and/or mixing using mixing chamber 60. As discussed herein, the axis of rotation may preferably be the center 12 of the sample processing device 10. In some instances in which sample material is delivered to the process chamber 40 through a conduit 32, the distal side of the process chamber 40 may be defined as the side opposite the delivery port 34 through which the sample material enters the process chamber 40. In such an embodiment, the delivery port 34 may preferably be located in the proximal side of the process chamber 40, i.e., the side of the process chamber 40 that is closest to the axis about which the sample processing device 10 is rotated to effect fluid movement.

The valve 44 depicted in FIG. 2 can be opened to allow sample material in the process chamber 50 to move into conduit 42 for delivery to the secondary process chamber 50. The valve 44 may take the form of a valve septum 46 provided in a valve lip 48 overhanging a portion of the process chamber 40 as depicted in the cross-sectional view of FIG. 3. Further examples and discussions of such valve structures may be found in, e.g., U.S. Patent Application Publication No. US2003/138779 (Parthasarathy et al.) and U.S. Pat. No. 7,322,254 (Bedingham et al.).

Figure 3:
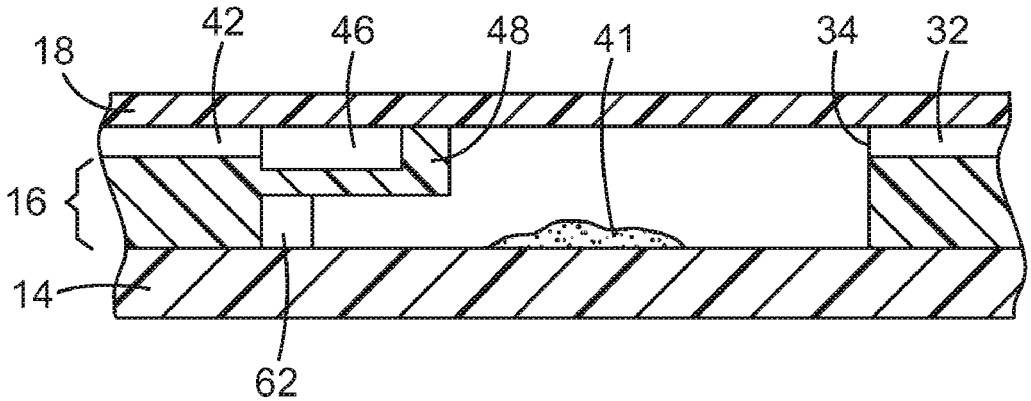
FIG. 3 is an enlarged cross-sectional view of the process chamber of FIG. 2, taken along line 3-3 in FIG. 2.

Although sample processing devices of the present invention may be manufactured using any number of suitable construction techniques, one illustrative construction can be seen in the cross-sectional view of FIG. 3. The sample processing device 10 includes a base layer 14 attached to a core layer 16. A cover layer 18 is attached to the valve layer 16 over the side of the core layer 16 that faces away from the base layer 14.

The layers of sample processing device 10 may be manufactured of any suitable material or combination of materials. Examples of some suitable materials for the base layer 14 and/or core layer 16 include, but are not limited to, polymeric material, glass, silicon, quartz, ceramics, etc. For those sample processing devices 10 in which the layers will be in direct contact with the sample materials, it may be preferred that the material or materials used for the layers be non-reactive with the sample materials. Examples of some suitable polymeric materials that could be used for the substrate in many different bioanalytical applications may include, but are not limited to, polycarbonate, polypropylene (e.g., isotactic polypropylene), polyethylene, polyester, etc.

It may be preferred that, in some embodiments, the core layer 18 be transparent or translucent such that the features formed in the core layer 16 and/or base layer 14 may be seen through the cover layer 18. For example, in the depicted embodiment of sample processing device 10, the core layer 18 does allow for visualization of the features in the process array 20 as described herein.

The layers making up sample processing device 10 may be attached to each other by any suitable technique or combination of techniques. Suitable attachment techniques preferably have sufficient integrity such that the attachment can withstand the forces experienced during processing of sample materials in the process chambers. Examples of some of the suitable attachment techniques may include, e.g., adhesive attachment (using pressure sensitive adhesives, curable adhesives, hot melt adhesives, etc.), heat sealing, thermal welding, ultrasonic welding, chemical welding, solvent bonding, coextrusion, extrusion casting, etc. and combinations thereof. Furthermore, the techniques used to attach the different layers may be the same or different. For example, the technique or techniques used to attach the base layer 14 and the core layer 16 may be the same or different as the technique or techniques used to attach the cover layer 18 and the core layer 16.

By locating the mixing port 62 on the distal side of the process chamber 40, changing the rotational speed of the sample processing device 10 can be used to selectively move sample material into and out of the mixing chamber 60. Movement of sample material into and out of the mixing chamber 60 from the process chamber 40 may be useful to, e.g., mix the sample material with, e.g., a reagent 41 located within the process chamber 40. Such a reagent 41 is depicted in the enlarged cross-sectional view of FIG. 3.

Figure 4:
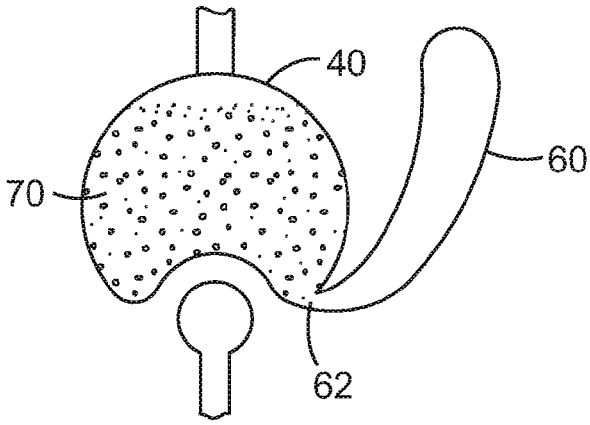
FIGS. 4 & 5 depict mixing actions using a process chamber and mixing chamber in one embodiment of the present invention.
Figure 5:
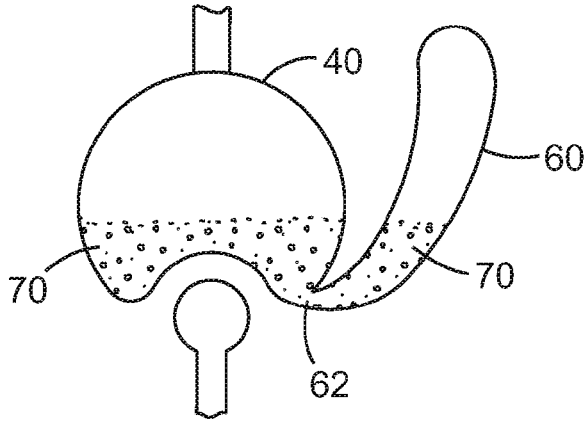

FIGS. 4 & 5 depict movement of sample material 70 into and out of mixing chamber 60. In FIG. 4, the sample material 70 is located substantially within process chamber 40. The sample material 70 may have been delivered to the process chamber 40 through, e.g., conduit 32 from loading chamber 30 through rotation of the sample processing device 10. Although the rotation of sample processing device 10 may have been sufficient to deliver the sample material 70 to the process chamber, the centrifugal forces developed by the rotation were not sufficient to cause the sample material 70 to enter the mixing chamber 60.

Once in position within process chamber 40 as seen in FIG. 4, however, the mixing port 62 leading to mixing chamber 60 is preferably closed off by the sample material 70. As a result, any air or other compressible fluid located within mixing chamber 60 is entrapped therein.

If the sample processing device 10 is rotated faster such that the centrifugal forces on the sample material 70 increase, at least a portion of the sample material 70 is preferably forced into the mixing chamber 60 through mixing port 62 as depicted in, e.g., FIG. 5. The air or other compressible fluid (preferably a gas) located within the mixing chamber 60 is preferably compressed within the mixing chamber 60 due to the centrifugal forces acting on the denser sample material 70. Reducing the rotational speed of the sample processing device 10 may preferably return at least some, and perhaps preferably all of the sample material 70 to the process chamber 40.

If rotation is used to accomplish mixing according to the present invention, the rotation may preferably include at least one acceleration and deceleration cycle, i.e., the rotational speed of the sample processing device 10 may be increased to drive at least a portion of the sample material 70 into the mixing chamber 60 followed by deceleration to a lower rotational speed (or to a stop) such that at least a portion of the sample material 70 moves out of the mixing chamber 60. In some instances, it may be preferred that the mixing involve two or more such acceleration and deceleration cycles.

Repeated movement of the sample material 70 into and out of the mixing chamber 60 by changing the rotational speed of the sample processing device 10 may enhance mixing of the sample materials 70 and any reagents located within the process chamber 40. Furthermore, in some instances, one or more reagents may be provided in the mixing chamber 60 such that contact of the sample material 70 with such reagents may preferably be controlled by changing the rotational speed of the sample processing device 10. For example, the time of initial contact of the sample material 70 with reagent (s) located in the mixing chamber 60 may be controlled based on the rotational speed of the sample processing device 10.

Figure 6:
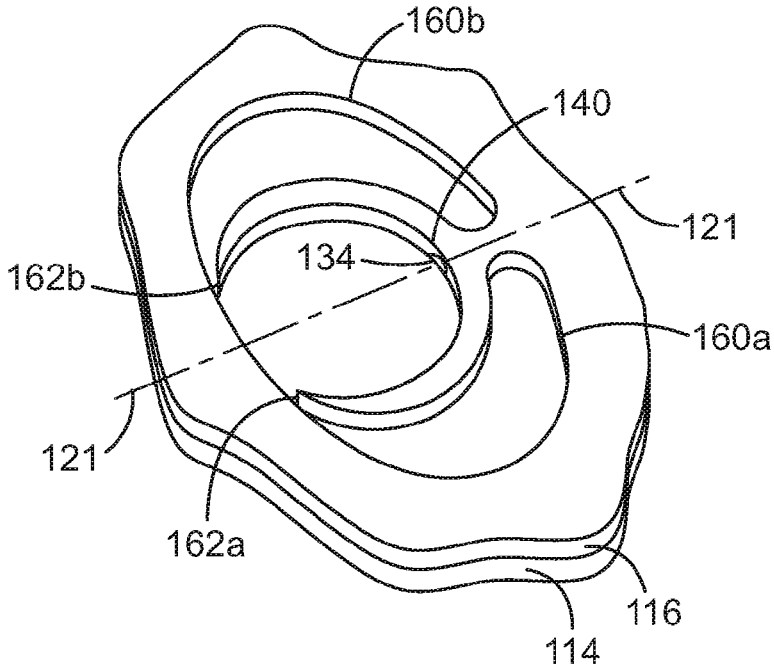
FIG. 6 is a perspective view of an alternative process chamber and associated mixing structure according to the present invention.

FIG. 6 is another alternative embodiment of a process chamber and associated mixing structure in accordance with the principles of the present invention. In many respects, the process chamber 140 and associated mixing structure are similar to that described in connection with FIGS. 1-5. Among the differences are that the mixing structure is provided in the form of two mixing chambers 160*a* and 160*b* that are in fluid communication with the process chamber 140 through mixing ports 162*a* and 162*b*, respectively.

The mixing chambers 160*a* and 160*b* (collectively referred to herein as mixing chambers 160) may preferably be located on opposite sides of the radial axis 121 along which process chamber 140 is located. As depicted, radial axis 121 may preferably be an axis of symmetry for the mixing chambers 160.

The process chamber 140 also includes a delivery port 134 through which sample material may be delivered to the process chamber 140. The delivery port 134 may preferably be located on the proximal side of the process chamber 140, i.e., the side of the process chamber 140 that is closest to the axis about which the sample processing device containing process chamber 140 is rotated to effect fluid movement and/or sample material mixing using mixing chambers 160.

As seen in FIG. 6, the features (e.g., process chamber 140, mixing chambers 160, delivery port 134, etc.) are formed in a core layer 116 to which a base layer 114 is attached. In the actual device, a cover layer (not shown) is provided over the major surface of the core layer 116 that is opposite the major surface to which base layer 114 is attached.

Figure 7:
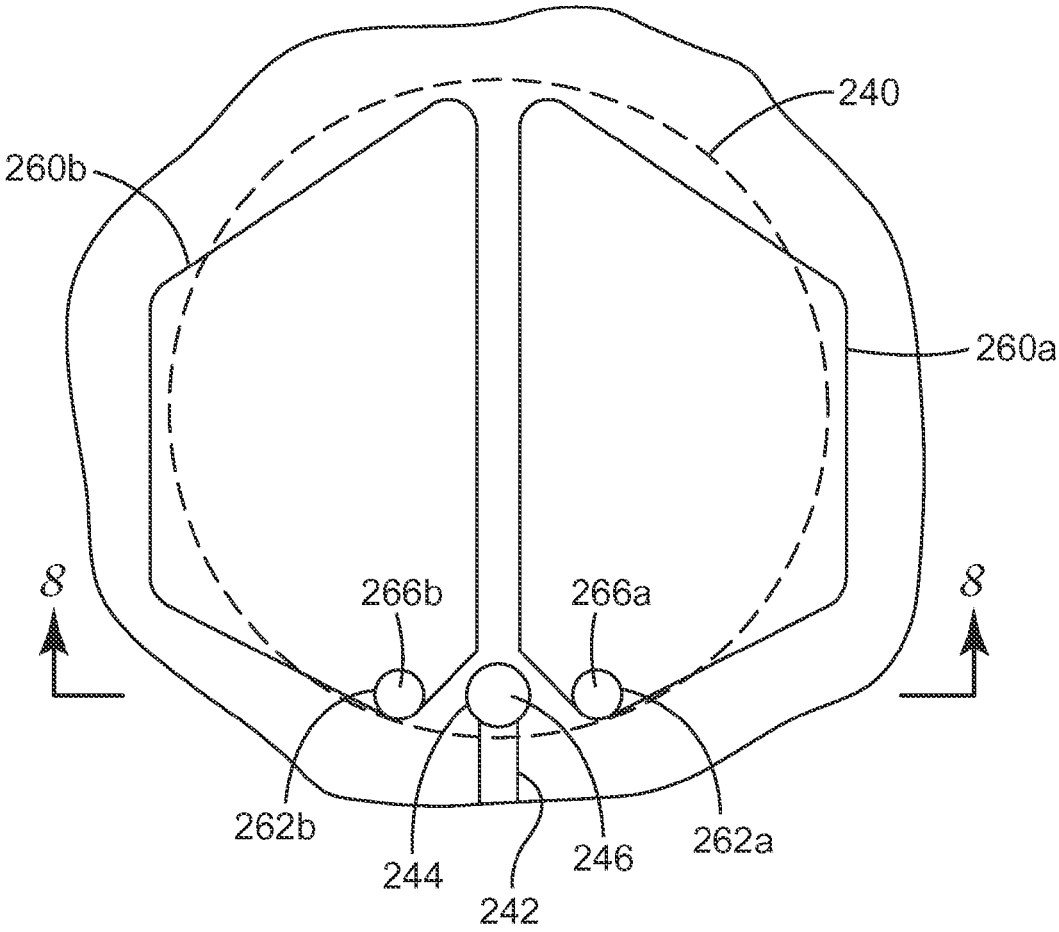
FIG. 7 is a perspective view of another alternative process chamber and associated mixing structure according to the present invention.
Figure 8:
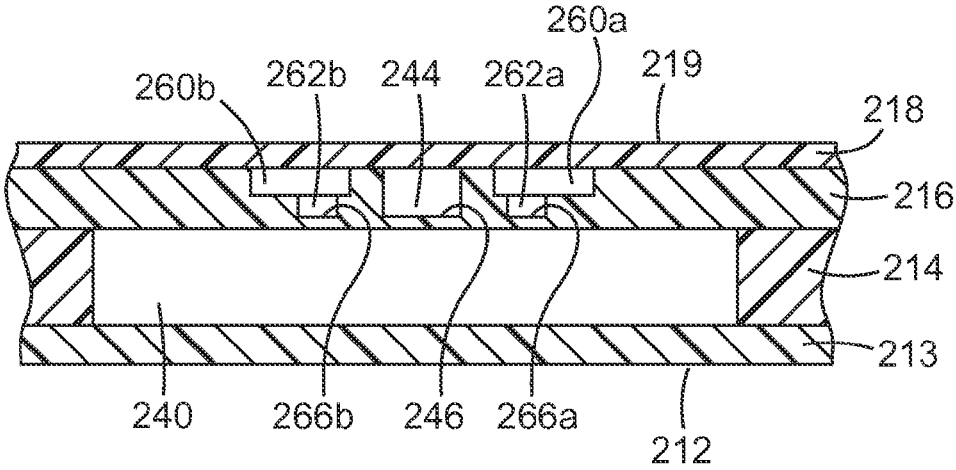
FIG. 8 is an enlarged cross-sectional view of the process chamber and associated mixing structure of FIG. 7, taken along line 8-8 in FIG. 7.

FIGS. 7 & 8 depict another embodiment of a process chamber 240 and associated mixing structure, with FIG. 8 being a cross-sectional view taken along line 8-8 in FIG. 7. In this embodiment, the mixing structure includes two mixing chambers 260*a* and 260*b* (collectively referred to herein as mixing chambers 260). The mixing chambers 260 are located above the process chamber 240 such that at least a portion of each of the process chambers 260 is located between the process chamber 240 and one of the major sides 212, 219 of the sample processing device in which the process chamber 240 is located. As such, the mixing chambers 260 may be described as having portions that are located within the footprint of the process chamber 240, where the footprint of the process chamber 240 is defined as the projection of the process chamber 240 on a major side 219 of the sample processing device along an axis that is normal to the major side 219. Although not depicted, it may be preferred that the mixing chamber or mixing chambers are located completely within the footprint of the process chamber 240.

One potential advantage of constructions in which portions or all of the mixing chamber or chambers are located within the footprint of the process chamber is that the mixing structure does not substantially enlarge the amount of area required on the sample processing device to provide a process chamber with mixing structure.

Because the mixing chambers 260 are located above the process chamber 240, the are connected thereto by mixing ports 262*a* and 262*b* that extend through mixing layer 216 connected to the base layer 214. The process chamber 240 is defined in the base layer 214 and also by a base cover layer 213 attached to the base layer 214. A cover layer 218 attached to mixing layer 216 further defines the volumes of the mixing chamber 260.

The process chamber 240 includes an optional valve 244 with a valve septum 246 that is opened to allow sample material to flow into conduit 242 for delivery to other features that may be present on the sample processing device.

In addition, the mixing ports 262*a* and 262*b* also include optional valves in the form of septums 266*a* and 266*b* that must be opened to allow any sample material in the process chamber 240 to enter the one or both of the mixing chambers 260. The septums 266*a* and 266*b* may be opened by any suitable technique used in connection with, e.g., septum 246 of valve 244. The use of valves in connection with mixing chambers 260 may be particularly useful if, e.g., the mixing chambers 260 include one or more reagents located therein and contact of those reagents and the sample material is to be controlled.

As used herein and in the appended claims, the singular forms "a," "and," and "the" include plural referents unless the context clearly dictates otherwise. Thus, for example, reference to "a mixing chamber" includes a plurality of mixing chambers and reference to "the process chamber" includes reference to one or more process chambers and equivalents thereof known to those skilled in the art.

All references and publications cited herein are expressly incorporated herein by reference in their entirety into this disclosure. Illustrative embodiments of this invention are discussed and reference has been made to possible variations within the scope of this invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A method of mixing fluids in a sample processing device, the method comprising:

providing a sample processing device comprising a process chamber, at least one mixing chamber, and at least one mixing port located on a distal side of the process chamber;

providing sample material in the process chamber; and mixing the sample material by rotating the sample processing device about an axis of rotation, wherein at least a portion of sample material in the processing chamber moves into the at least one mixing chamber through the at least one mixing port when rotating the sample processing device, wherein mixing comprises at least one acceleration and deceleration cycle to allow the sample material to move between the process chamber and the mixing chamber.

2. A method according to claim 1, wherein mixing comprises two or more acceleration and deceleration cycles.

3. A method according to claim 1, wherein the at least one mixing port is closed and the method further comprises opening the at least one mixing port such that the process chamber and the at least one mixing chamber are in fluid communication before mixing.

4. A method according to claim 1, wherein the process chamber comprises a reagent, and wherein mixing the sample material includes mixing the sample material with the reagent.

5. A method according to claim 1, wherein the at least one mixing chamber comprises a reagent, and wherein mixing the sample material includes mixing the sample material with the reagent.

6. A method according to claim 1, wherein the at least one mixing chamber comprises two or more mixing chambers, wherein each mixing chamber of the two or more mixing chambers comprises one mixing port of the at least one mixing port.

7. A method according to claim 1, wherein the process chamber comprises an exit port, and wherein the method further comprises opening the exit port after mixing the sample material.

8. A method according to claim 7, further comprising rotating the sample processing device about the axis of rotation to remove at least a portion of the sample material from the process chamber through the exit port.

9. A method of mixing fluids in a sample processing device, the method comprising:

providing a sample processing device comprising a process chamber, at least one mixing chamber, and at least one mixing port located on a distal side of the process chamber;

providing sample material in the process chamber;

mixing the sample material by rotating the sample processing device about an axis of rotation, wherein at least a portion of sample material in the process chamber moves into the at least one mixing chamber through the at least one mixing port when rotating the sample processing device, wherein mixing comprises two or more acceleration and deceleration cycles;

opening an exit port in the process chamber after mixing the sample material; and removing at least a portion of the sample material from the process chamber and the mixing chamber through the exit port by rotating the sample processing device about the axis of rotation.

10. A method of mixing fluids in a sample processing device, the sample processing device adapted to rotate about an axis of rotation, the method comprising:

providing a sample processing device comprising:

a process chamber comprising a proximal side and a distal side, wherein the proximal side of the process chamber is located closer to the axis of rotation than the distal side of the process chamber, a mixing port located on a distal side of the process chamber, and a mixing chamber comprising a distal side, wherein the distal side of the mixing chamber is located no further from the axis of rotation than the distal side of the process chamber;

providing sample material in the process chamber; and mixing the sample material by rotating the sample processing device about the axis of rotation, wherein at least a portion of sample material in the process chamber moves into the mixing chamber through the mixing port when rotating the sample processing device, wherein mixing comprises at least one acceleration and deceleration cycle to allow the sample material to move between the process chamber and the mixing chamber.

* * * * *

UNITED STATES PATENT AND TRADEMARK OFFICE

CERTIFICATE OF CORRECTION

PATENT NO. : 8,057,757 B2
APPLICATION NO. : 12/902489
DATED : November 15, 2011
INVENTOR(S) : Bedingham et al.

It is certified that error appears in the above-identified patent and that said Letters Patent is hereby corrected as shown below:

Column 8

Line 2, Delete "the are" and insert -- they are --, therefor.

Line 54, In Claim 1, delete "processing" and insert -- process --, therefor.

Signed and Sealed this
Seventeenth Day of January, 2012

David J. Kappos

David J. Kappos
*Director of the United States Patent and Trademark Office*